US010227918B2

(12) United States Patent
Stuart et al.

(10) Patent No.: US 10,227,918 B2
(45) Date of Patent: Mar. 12, 2019

(54) POLYGON OSCILLATING PISTON ENGINE

(71) Applicants: Martin A. Stuart, Burbank, CA (US); Stephen L. Cunningham, Altadena, CA (US)

(72) Inventors: Martin A. Stuart, Burbank, CA (US); Stephen L. Cunningham, Altadena, CA (US)

( * ) Notice: Subject to any disclaimer, the term of this patent is extended or adjusted under 35 U.S.C. 154(b) by 1179 days.

(21) Appl. No.: 14/395,172

(22) PCT Filed: Apr. 11, 2013

(86) PCT No.: PCT/US2013/036099

§ 371 (c)(1),
(2) Date: Oct. 17, 2014

(87) PCT Pub. No.: WO2013/158452

PCT Pub. Date: Oct. 24, 2013

(65) Prior Publication Data

US 2015/0059681 A1 Mar. 5, 2015

Related U.S. Application Data

(60) Provisional application No. 61/625,940, filed on Apr. 18, 2012.

(51) Int. Cl.
*F02B 53/02* (2006.01)
*F01B 5/00* (2006.01)
(Continued)

(52) U.S. Cl.
CPC ..... *F02B 53/02* (2013.01); *F01B 5/00* (2013.01); *F01B 7/00* (2013.01); *F01B 9/023* (2013.01);
(Continued)

(58) Field of Classification Search
CPC ..... F01B 2009/045; F01B 5/00; F01B 7/00; F01B 9/023; F01C 9/00; F02B 53/02; F02B 75/265; F02B 75/28; F02B 75/32
(Continued)

(56) References Cited

U.S. PATENT DOCUMENTS 556,032 A 3/1896 Stanbridge
2,085,070 A 11/1933 Pavlecka
(Continued)

FOREIGN PATENT DOCUMENTS

WO 9214036 8/1992

OTHER PUBLICATIONS

PCT International Search Report; International Application No. PCT/US2013/036099; Date of Actual Completion of International Search: Jun. 27, 2013; Date of Mailing of the International Search Report: dated Jul. 11, 2013.
(Continued)

*Primary Examiner* — Mark Laurenzi
*Assistant Examiner* — Paul Thiede
(74) *Attorney, Agent, or Firm* — Bodi Law LLC; Robert F. Bodi

(57) ABSTRACT

A Polygon Oscillating Piston Engine having multiple pistons on one of two oscillating disks. Each piston moves in a straight line along one of the sides of a polygon within a cylindrical chamber, while the oscillating disks move in an arc about a central shaft. The difference in the straight motion of the piston and angular motion of the oscillating disk is accommodated by a slip sleeve within the piston that slides on a peg or bar mounted to each disk. The engine can be configured to operate as an internal combustion engine that uses diesel fuel, gasoline, or natural gas, or it can be configured as an expander to convert high pressure high
(Continued)

temperature gas to rotary power. This engines compact design results in a high power-to-weight ratio.

31 Claims, 25 Drawing Sheets

(51) Int. Cl.

| | |
|---|---|
| ***F02B 75/28*** | (2006.01) |
| ***F02B 75/32*** | (2006.01) |
| ***F01B 7/00*** | (2006.01) |
| ***F01B 9/04*** | (2006.01) |
| ***F01C 9/00*** | (2006.01) |
| ***F02B 75/26*** | (2006.01) |
| ***F01B 9/02*** | (2006.01) |

(52) U.S. Cl.
CPC ..... *F01C 9/00* (2013.01); *F02B 75/265* (2013.01); *F02B 75/28* (2013.01); *F02B 75/32* (2013.01); *F01B 2009/045* (2013.01)

(58) Field of Classification Search
USPC ..... 123/18 R, 245
See application file for complete search history.

(56) References Cited

U.S. PATENT DOCUMENTS

| | | | |
|---|---|---|---|
| 2,300,191 | A | 10/1942 | Young |
| 2,301,667 | A | 11/1942 | Lutz |
| 2,606,541 | A | 8/1952 | Lutz |
| 3,237,403 | A | 3/1966 | Feher |
| 3,359,957 | A | 12/1967 | Mantzel |
| 3,516,392 | A | 6/1970 | Morgan |
| 3,580,228 | A | 5/1971 | Rocha |
| 3,990,405 | A | 11/1976 | Kecik |
| 4,058,088 | A | 11/1977 | Brown |
| 4,127,036 | A | 11/1978 | Pinto |
| 4,257,752 | A | 3/1981 | Fogarty |
| 4,663,939 | A | 5/1987 | Cosby |
| 4,970,995 | A | 11/1990 | Parsons |
| 5,188,083 | A | 2/1993 | Reisser et al. |
| 5,203,287 | A | 4/1993 | Wiley |
| 5,222,463 | A | 6/1993 | Farrell |
| 5,302,253 | A | 4/1994 | Lessard et al. |
| 5,303,546 | A | 4/1994 | Farrell |
| 5,323,737 | A | 6/1994 | Farrell |
| 5,324,176 | A | 6/1994 | Farrell |
| 5,327,745 | A | 7/1994 | Gilmour |
| 5,467,744 | A | 11/1995 | Farrell |
| 5,527,165 | A | 6/1996 | Schadeck |
| 5,794,573 | A | 8/1998 | Sunley |
| 6,293,775 | B1 | 9/2001 | Bakhtine |
| 6,739,307 | B2 | 5/2004 | Morgado |
| 6,814,205 | B2 | 11/2004 | Feldhaus et al. |
| 6,860,373 | B2 | 3/2005 | Kundermann et al. |
| 6,880,494 | B2 | 4/2005 | Hoose |
| 6,990,942 | B2 | 1/2006 | Takeuchi |
| 7,114,605 | B2 | 10/2006 | Grosspietsch et al. |
| 7,182,061 | B2 | 2/2007 | Georgescu |
| 7,237,542 | B2 | 7/2007 | Reisser |
| 7,240,645 | B2 | 7/2007 | Reisser |
| 7,380,527 | B2 | 6/2008 | Reisser |
| 7,415,962 | B2 | 8/2008 | Reisser |
| 7,600,490 | B2 | 10/2009 | Reisser |
| 7,721,701 | B2 | 5/2010 | Dec |
| 7,730,869 | B2 | 6/2010 | Li |
| 8,210,151 | B2 | 7/2012 | Drachko |
| 9,835,083 | B2 * | 12/2017 | Cunningham ..... F01C 9/002 |
| 2004/0184923 | A1 | 9/2004 | Iwanami et al. |
| 2005/0050892 | A1 | 3/2005 | Gould |
| 2007/0175212 | A1 | 8/2007 | Uno et al. |
| 2007/0199323 | A1 | 8/2007 | Yamaguchi et al. |
| 2007/0199537 | A1 | 8/2007 | Morgado |
| 2008/0245345 | A1 | 10/2008 | Huettlin |
| 2009/0165461 | A1 | 7/2009 | Klassen et al. |
| 2009/0266075 | A1 | 10/2009 | Westmeier et al. |
| 2010/0024421 | A1 | 2/2010 | Litwin et al. |
| 2010/0287920 | A1 | 11/2010 | Duparchy |
| 2012/0174585 | A1 | 7/2012 | Rampen et al. |

OTHER PUBLICATIONS

SINTEF Energy Research; TR No. TR A6570; Date: Oct. 8, 2007; Project No. 16X732; Technical Report entitled "Co2 as working fluid in a Rankine cycle for electricity production from waste heat sources on fishing boats".

Dostal: The MIT Center for Advanced Nuclear Energy Systems; Advanced Nuclear Power Technology Program; "A Supercritical Carbon Dioxide Cycle for Next Generation Nuclear Reactors"; V. Dostal, M.J. Driscoll, P. Hejzlar: MIT-ANP-TR-100; Mar. 10, 2004.

Chen et al.; A comparative study of the carbon dioxide transcritical power cycle compared with an organic rankine cycle with R123 as working fluid in waste heat recovery; Applied Thermal Engineering 26 (2006); pp. 2142-2147.

Yamaguchi et al.; Solar energy powered Rankine cycle using supercritical CO2; Applied Thermal Engineering 26 (2006); pp. 2345-2354.

Dostal; A Supercritical Carbon Dioxide Cycle for Next Generation Nuclear Reactors; Czech Technical University in Prague, Czech Republic (2006); From Massachusetts Institute of Technology Libraries, Jun. 16, 2004.

Wikipedia, the free encyclopedia; Swing-Piston Engine; 3 pages; Otto Lutz; internal combustion swing-piston engine; publication date unknown.

* cited by examiner

POLYGON OSCILLATING PISTON ENGINE

CROSS REFERENCES TO RELATED APPLICATIONS

This application is a national stage application of PCT application Serial No. PCT/US2013/036099 filed on Apr. 11, 2013 and incorporated herein by reference, which claims the benefit of U.S. provisional application Ser. No. 61/625,940 that was filed on Apr. 18, 2012 and is incorporated by reference herein.

FIELD

This invention relates generally to the field of internal combustion engines. More specifically, this invention relates to the conversion of energy from chemical energy from the combustion of a variety of petroleum products into rotational mechanical energy using an oscillating disk methodology. The rotational mechanical energy can be used to drive a generator to create electricity or drive a transmission in a moving vehicle (e.g., a car, truck, plane, or boat).

BACKGROUND

Many different configurations of internal combustion engines have been introduced historically, with inline and V-configurations having become dominant. Other configurations use opposed pistons where two pistons come together in a single combustion chamber. More recently, configurations where the combustion chamber is a toroid and where multiple pistons move in an oscillating manner have been proposed. One such engine is disclosed in U.S. patent application Ser. No. 13/074,510, filed on Mar. 29, 2011, and incorporated herein by reference. These engines have the advantage of having a high power-to-weight ratio and they offer high torque at low engine speed. These have the disadvantage, however, of being difficult to manufacture and of having unreliable piston seals due to the motion of the piston in an arc. An engine design that solves these problems is desirable.

SUMMARY

The current embodiments described herein overcome the disadvantages of the toroidal engine while keeping the advantages. It does this by having the pistons arranged in a polygon with straight sides. Each piston moves in a straight cylinder with conventional piston rings. The combustion chambers lie at the intersection of the sides of the polygon. The pistons in adjacent positions around the polygon move toward and away from each other giving the advantages of the opposed-piston configuration with a common combustion chamber in between. In addition, the drive mechanism that connects the oscillating pistons to the rotating crank shaft has been simplified to lower the part count and subsequent cost of construction.

The power to weight ratio of this engine is very high. This comes about for several reasons. First is the use of opposed pistons. For opposed pistons, the speed of a piston is around half that of a conventional piston engine for the same displacement. This allows the engine to run at about twice the rotational speed and therefore generate about twice the power with about the same displacement as prior art engines. Second is the use of two sided pistons. This was common with steam engines, but is not common with gasoline engines. The improved design uses two sided pistons arranged in a closed polygon. Third is the optional use of a two cycle design rather than the more common four cycle design. These last two items allow every stroke of every piston to be a power stroke. This is in contrast to the conventional automobile engine where every fourth stroke is a power stroke, or the conventional two cycle engine where every second stroke is a power stroke. Finally, the weight is greatly reduced compared to an opposed piston engine in that the invention herein has the same number of power producing combustion chambers as there are pistons, whereas the conventional opposed piston engines have one combustion chamber for two pistons.

The engine designs described herein are a piston based engines where the piston chambers are arranged as the sides of a polygon. The polygon can have any even number of sides starting with four. The embodiment shown here has six sides, but engines with eight, ten, or twelve sides are also possible and may be preferred in some applications. There is no limit to the number of sides, but the disclosed designs use an even number of sides.

For an example embodiment, the pistons are attached to one of two disks, with the even piston numbers on one disk and the odd piston numbers on the other disk. Each disk can pivot on a central drive shaft. Each disk has a set of pegs or bars that extend in the radial direction (one for each piston) and which slides in a sleeve that pivots in the center of each piston. The back and forth oscillating motion of the piston within its cylinder is translated to the angular oscillation of the corresponding disks.

The two disks oscillate in opposition to one another. When the pistons on the first disk move in the clockwise direction, the pistons on the second disk move in the counter-clockwise direction, and vice versa. As the pistons approach each other, they compress the fuel-air mixture. At the point of closest approach, combustion occurs and the pistons are pushed apart. Then the pistons on each disk move to the opposite corner of the polygon and the process repeats. In a two cycle engine, every stroke of the two-sided piston is a power stroke. The operation of this engine is very similar to the operation of the toroidal engine describe in patent Ser. No. 13/074,510 entitled "Oscillating Piston Engine" filed Mar. 29, 2011, and incorporated herein by reference. The fundamental difference is that for the engine described herein, the pistons beneficially move in a straight line, whereas the pistons in the cited prior art design move in an arc.

The basic configuration is that of a polygon with an even number of sides. One or more crank shafts for the engine can be provided inside the polygon so that pistons occupy all sides of the polygon, or a crankshaft can be provided that actually occupies one of the sides of the polygon so that the total number of pistons becomes an odd number. With state-of-the art crankshaft designs, the former configuration will function well for lower power applications, whereas the latter configuration works well for high power applications. However, the former design can be made practical for higher power applications where stronger crankshafts are provided than are typically available. Embodiments using both configurations are described within this document.

BRIEF DESCRIPTION OF THE DRAWINGS

For a fuller understanding of the nature of the present invention, reference should be made to the following detailed description taken in conjunction with the following drawings.

DETAILED DESCRIPTION OF THE EXAMPLE EMBODIMENTS

Figure 1:
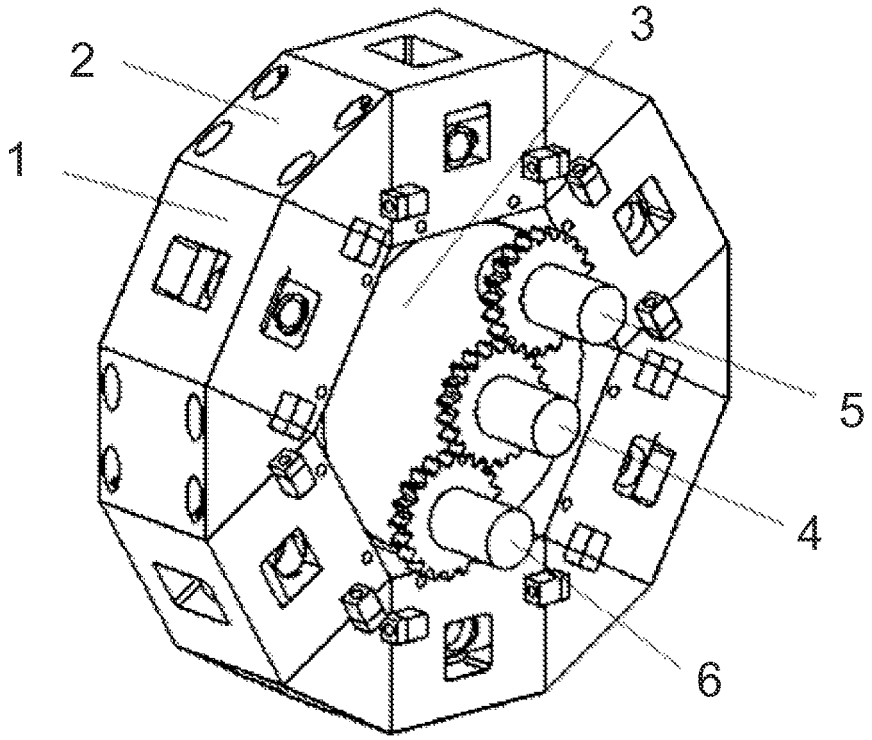
FIG. 1 is a schematic drawing showing the core of a first example embodiment of a hexagonal Polygon Oscillating Piston Engine having six pistons for a low power, low compression ratio engine.

FIG. 1 shows the central core of an example Polygon Oscillating Engine with six pistons. This is one example embodiment of the Polygon Oscillating Engine. Other alternative embodiments could be based on any even number sided polygon. The six pistons in this embodiment are in each of the six straight cylinders 1 arranged as a hexagon. Each cylinder is connected to the adjacent cylinder by one of the six corner combustion chambers 2. Central to the engine is a disk 3 that oscillates back and forth about a central shaft 4. The back and forth motion is controlled in this embodiment by two crank shafts 5 and 6. Various numbers of crank shafts could be utilized, ranging from one to four or more depending upon the specific sizes and applications.

Figure 2:
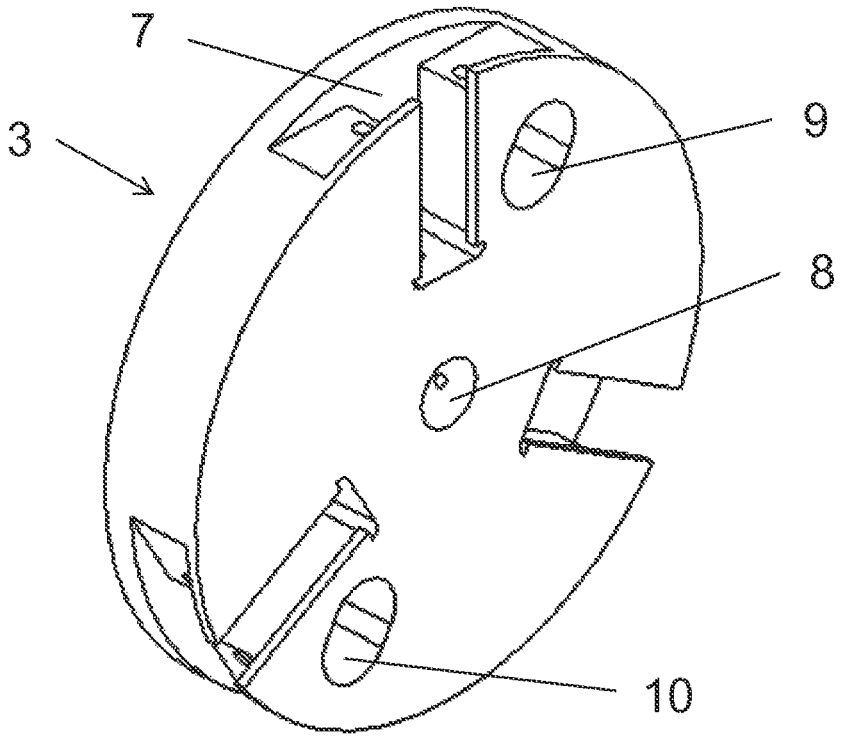
FIG. 2 is a schematic drawing showing one of the two core disks that holds the piston pegs for half of the pistons in the first example Polygon Oscillating Piston Engine.

FIG. 2 shows one embodiment of the two oscillating disks 3. In this embodiment, there are three grooves 7 where piston pegs can be attached. Each disk 3 has a central hole 8 that contains bearings that ride on the central shaft. A central main shaft (not shown) rotates freely within a bore hole 8 while the disk 3 oscillates back and forth. Two bore holes 9 and 10 that are oval in shape are provided. These holes 9 and 10 ride on cams that are part of the crank shafts, described below. In some embodiments, both holes 9 and 10 are the same, but in other embodiments, only one hole is oval in shape configured for riding on a cam while the other is oversized to allow free passage of the other crankshaft with no contact. That crankshaft will ride on the oval hole in the other disk.

Figures 3, 3A, 3B:
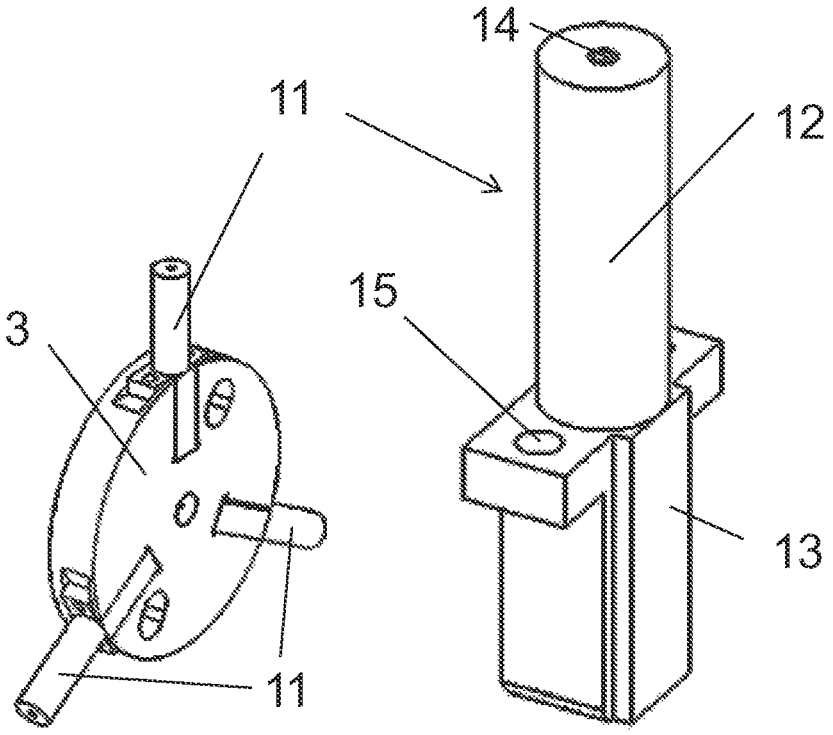
FIG. 3B is a schematic drawing showing an example embodiment of the piston peg that connects the disk to the piston.
FIG. 3A is a schematic drawing showing the location of the piston pegs in the core disk.

FIG. 3B shows one embodiment of a piston peg 11. The piston peg 11 is made separate from the disk 3 for ease of manufacturing. The piston peg 11 has a smooth cylinder portion 12 that connects to the piston. The peg has a base 13 that is rectangular and that fits tightly in the grooves 7 on the disk 3. The peg has a central hole 14 that extends the length of the peg 11 and that allows for oil to flow from the central main shaft 4 up to the piston. The holes 15 are for receiving screws to secure the peg 11 to the disk 3 such as shown in FIG. 3A.

Figure 4:
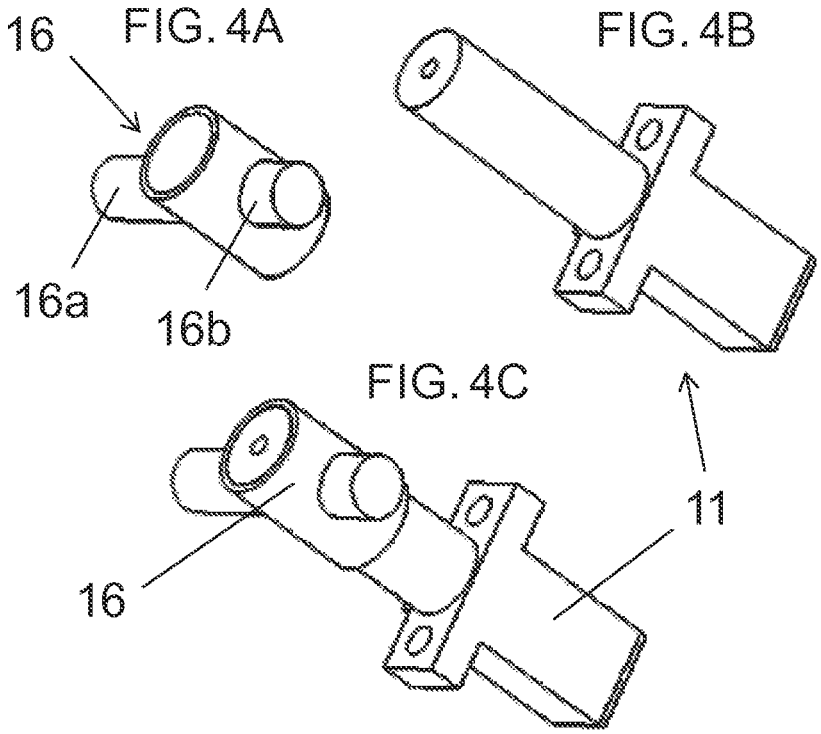
FIG. 4A is a schematic drawing showing an example piston peg collar that slides on the piston peg a small distance as the piston moves back and forth in the cylinder.
FIG. 4B is a schematic drawing showing the example peg.
FIG. 4C is a schematic drawing showing the placement of the collar on the peg.

FIG. 4A shows a piston peg sleeve 16 and FIG. 4C shows the peg sleeve 16 fitting over the end of the piston peg 11. The two cylinder pieces 16*a*, 16*b* that extend out of the sides of the sleeve 16 connect to a bearing in the piston and allow tilting of the piston with respect to the peg 11.

Figure 5:
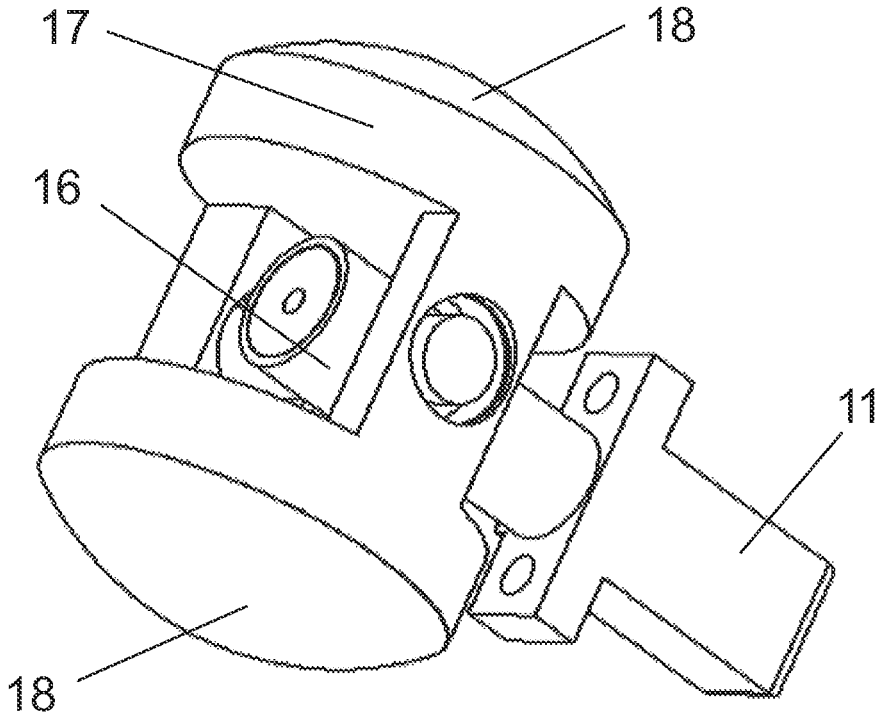
FIG. 5 is a schematic drawing showing one example of the piston mounted on the piston peg collar along with the piston peg.

FIG. 5 shows an example of the piston 17 to piston sleeve 16 to piston peg 11 combination with the cylinder piece 16*a* and 16*b* (not shown) engaging the piston 17. The piston 17 can rotate about the cylinders 16*a*, 16*b* on the piston sleeve 16 that rides on piston peg 11. As the piston 17 moves back and forth in a straight line in its cylinder, the piston peg 11 rotates through a small angle as disk 3 oscillates back and forth on the central shaft 4 allowing the piston 17 to travel in a straight line as the disk oscillates. A disconnect between the linear motion of the piston 17 and an angular motion (and radial motion) of the piston peg 11 as the disk oscillates is accommodated by the radial sliding of the piston sleeve 16 on the cylindrical part of the piston peg 11. The piston faces 18 on both ends of the piston are shown as sections of a dome in this embodiment. Other shapes for the face of the piston are possible and they are determined by the chosen shape of the corner combustion chambers 2.

Figure 6:
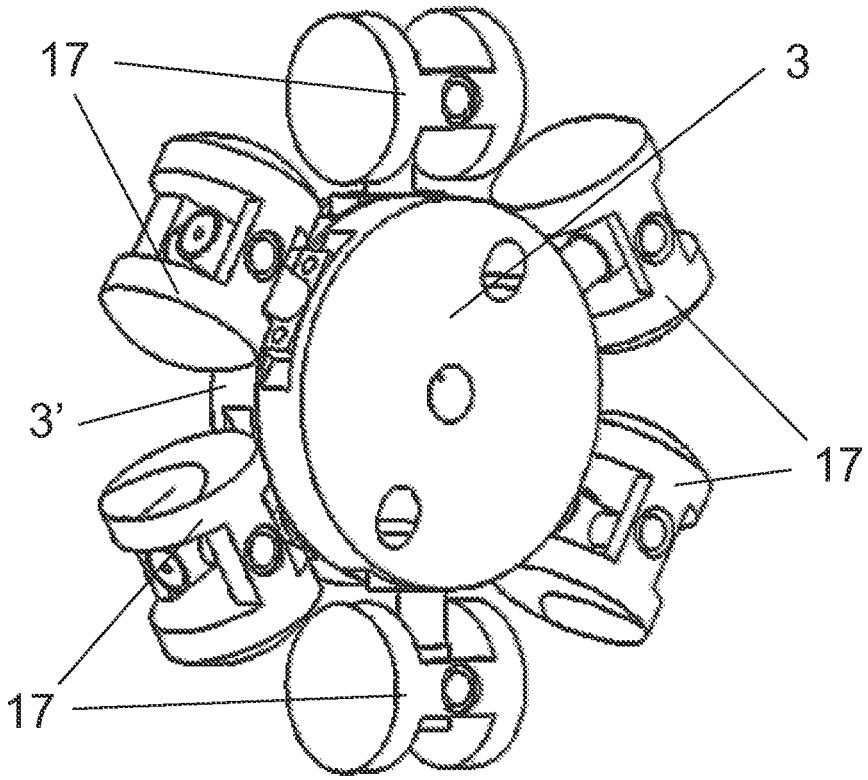
FIG. 6 is a schematic drawing showing six pistons arranged on both of the disks as would appear for the hexagonal embodiment of the hexagonal example embodiment of the Polygon Oscillating Piston Engine.

FIG. 6 shows the arrangement of the six pistons 17 in this embodiment on the two disks 3 and 3'. Half of the number of pistons are on the front disk 3 and half are on the back disk 3' which is identical but flipped 180 degrees. The disks 3, 3' oscillate in opposite directions (out of phase) about the center shaft (not shown). Note that the piston pegs, which extend out straight from the disk, do not go to the centers of the pistons 17 in this example. This off-center displacement is not required, but allows the pistons attached to one disk to be in the same plane as the pistons attached to the other disk. All pistons can be in the same plane, which makes the corner combustion chambers have a straight through passage for the combustion products, or the pistons can be in two off-set planes such that the corner combustion chambers have a angled passage connecting the region above the two adjacent pistons.

Figure 7:
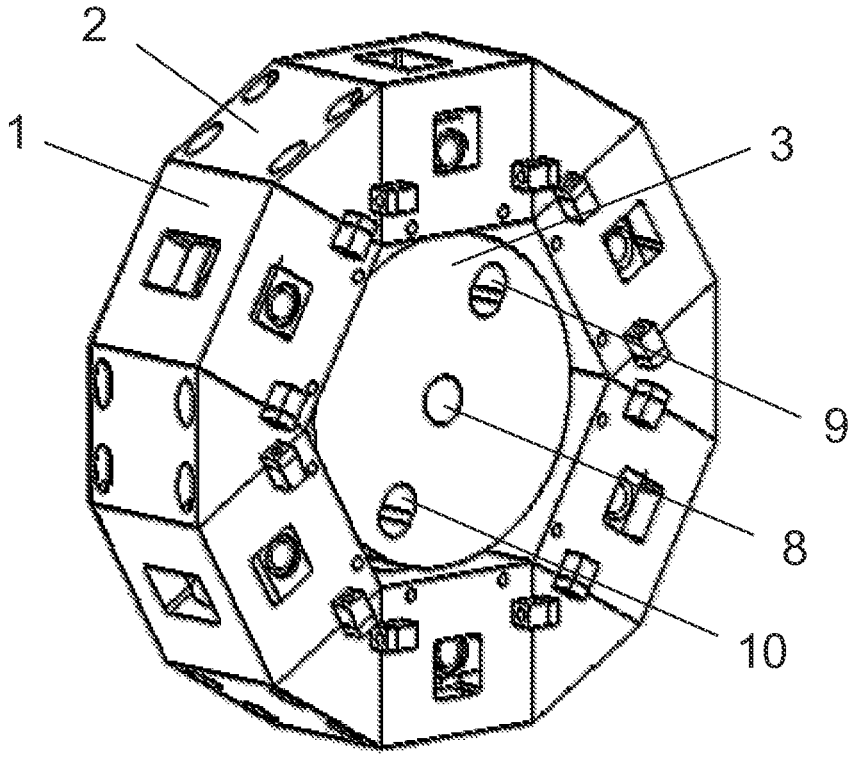
FIG. 7 is a schematic drawing showing example core piston cylinders and the corner combustion chambers for the example hexagonal embodiment of the Polygon Oscillating Piston Engine.

FIG. 7 shows the arrangement of the six pistons encased in the cylinders 1 and the corner combustion chambers 2. The disk 3 oscillates about the central shaft (not shown) which goes through the central hole 8. The crank shafts (not shown) extend through the offset holes 9 and 10 and convert the back and forth motion of the disks to rotational motion for transfer to the central shaft. This example embodiment can be readily configured as a two cycle engine. For this two-cycle embodiment, inlet and exhaust ports are cut in the sides of the cylinders 1 that encase the pistons. A spark plug or a glow plug (for an embodiment consuming diesel fuel) will be located in the corner combustion chambers 2.

This example embodiment of FIG. 7 can be alternatively configured as a four cycle engine. For the four-cycle engine embodiment, the valves and spark plugs are located in the corner combustion chambers 2.

Finally, the example embodiment of FIG. 7 can also be configured as an expander or a compressor. For such applications, the inlet valves (which may be electrical injectors) and the exhaust valves are located in the corner combustion chambers 2.

Figure 8:
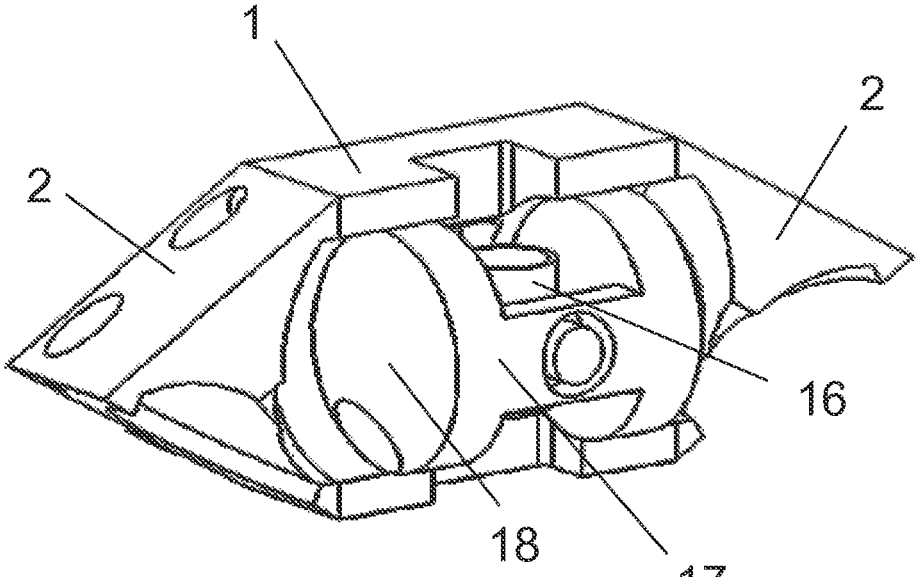
FIG. 8 is a schematic drawing showing a cut-away of one of the piston cylinders with a piston inside along with a cut-away of each of the combustion chambers at each end of the piston.

FIG. 8 is a cut-away showing a single piston 17 inside the cylinder 1 with two combustion chambers 2 on either end. In this embodiment, the pistons 17 have domed heads 18, and the chambers in the corner combustion chambers 2 have been shaped to accommodate the piston ends. Other embodiments of the shape of the combustion chamber are possible, accommodating piston ends that range from a flat surface to a curved surface to a pointed surface to a concave surface, or even more complex shapes.

Figure 9:
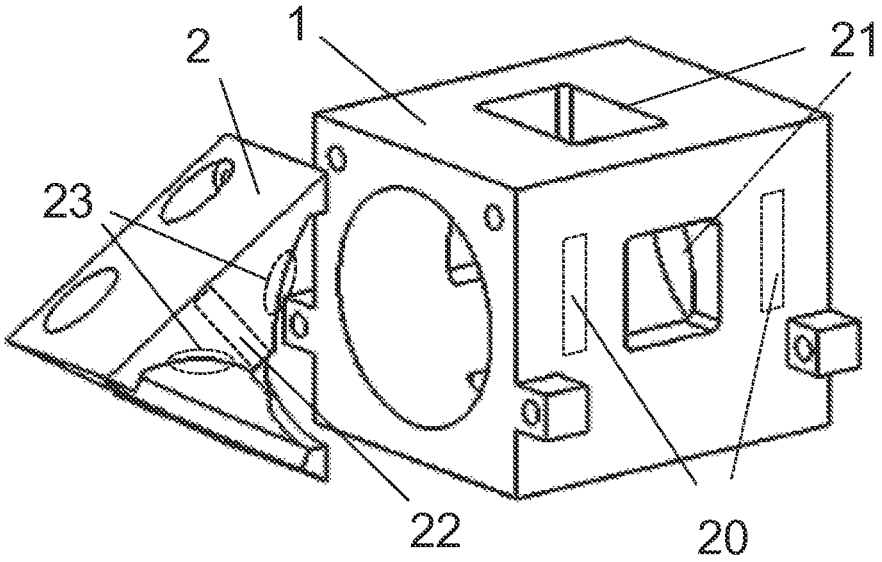
FIG. 9 is a schematic drawing showing a possible location of ports and a spark plug for a two cycle embodiment of the example Polygon Oscillating Piston Engine as well as a possible location of inlet and exhaust valves in a four cycle embodiment.

FIG. 9 shows possible locations of the ports 20 on the cylinders 1 that would be used for the two cycle embodiment of the Polygon Oscillating Piston Engine. The ports 20 are uncovered by the piston as it moves back and forth within the cylinder. The ports 20 shown in the figure could both be inlet ports, while the exhaust ports (not shown) could be on the opposite side of the next cylinder in the polygon. Inlet ports are only needed on half of the cylinders with the exhaust ports on the other half. This is because the adjacent cylinders communicate through the connecting corner combustion chamber 2. Openings 21 can be provided not as part of the fuel flow system for the pistons, but rather for providing access and making the cylinder lighter. The openings 21 are optional and are not an essential part of the Polygon Oscillating Piston Engine. Also shown is the possible location of a spark plug opening 22 in the cut-away view of the corner combustion chamber 2. This location may be used for either the two cycle or the four cycle embodiments of the engine. Finally, possible locations 23 are shown for placing the inlet and exhaust valves in the cut-away view of the corner combustion chamber 2 that would be appropriate for the four cycle embodiment or the expander embodiment of the Polygon Oscillating Engine. The inlet port could also be an injector, if desired.

Figure 10:
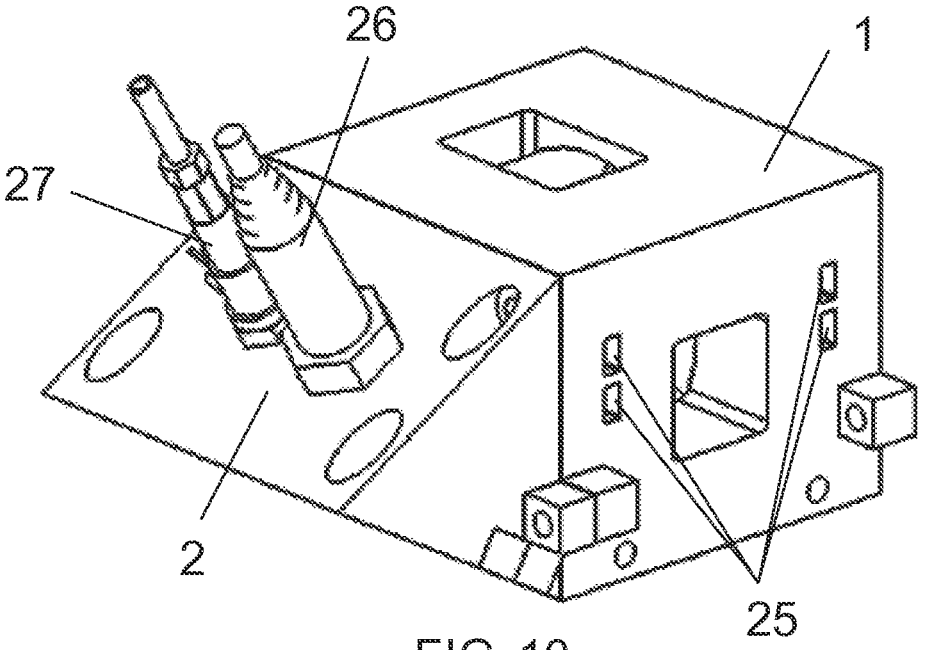
FIG. 10 is a schematic drawing showing one example of the placement of the spark plug, the fuel injector, and the ports for a two cycle configuration of the example engine.

FIG. 10 shows an example of the two cycle embodiment of the Polygon Oscillating Piston Engine with the location of a spark plug 26 and a fuel injector 27 which would be on each of the corner combustion chambers 2. Also shown is one possible location of exhaust ports 25, which would be on every other (alternate) piston cylinder 1. The two cycle embodiment can have both inlet and exhaust ports located as shown in FIG. 9, or exhaust ports only with a fuel injector as shown in FIG. 10, among other alternatives.

Figure 11:
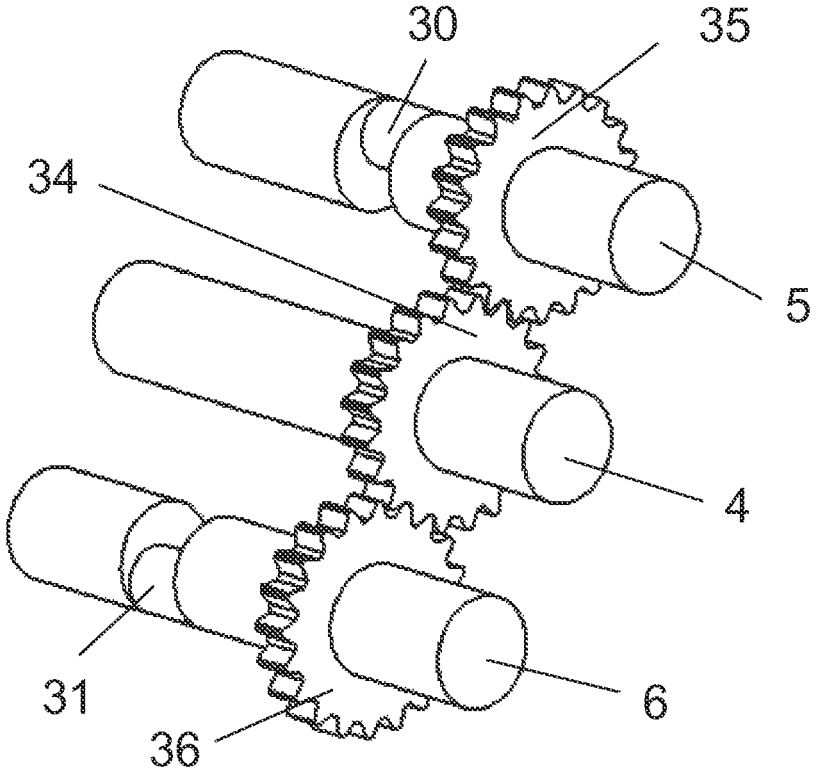
FIG. 11 is a schematic drawing showing one example of two crank shafts and a main shaft connected with a set of drive gears for the example engine.

FIG. 11 shows one example embodiment of the transmission structure that converts the oscillatory motion of the disks (not shown) to rotary motion of the main shaft 4. The main shaft 4 extends through the disks and rotates freely while the disks counter oscillate. The crank shafts 5 and 6 extend through the oval holes 9, 10 provided in the disks 3 as shown in FIG. 2. The offset cams 30 and 31 on each crankshaft 5 and 6 ride on a bearing along the edges of the oval holes in the disks. In the embodiment shown here, the cam 30 in the upper crank shaft rides on the edges of the oval hole 9 in the front disk 3 (see FIG. 2), and the cam 31 on the lower crank shaft 6 rides on the edges of the oval hole 10 in the back disk (see FIG. 2). The opposite hole in each disk for this embodiment is enlarged to allow the free passage of the crankshaft while the disks oscillate. Other embodiments are possible where, for example, there are two cams 30 on a single crankshaft which ride on bearings in both disks. Also, it is possible to have a different number of crank shafts, ranging from one up to four or more. A different embodiment is possible where the disk is connected to the offset cam by way of a push arm. The length of the push arm and the location of the attach point on the disk are constrained such that the motion of the piston in both directions is symmetrical about the midpoint. This constraint is described fully in patent application Ser. No. 13/074,510 entitled "Oscillating Piston Engine" filed Mar. 29, 2011, incorporated herein by reference.

The size of the offset in the cam 30 and 31 on each crankshaft 5 and 6 along with the shape of the corner combustion chamber in 2 determines the compression ratio of the engine. The compression ratio can vary from, for example, a low value of less than 2:1 for expander applications to greater than 20:1 for high performance diesel operations.

In FIG. 11, the main shaft 4 has a main gear 34 which meshes with gears 35 and 36 on each of the crank shafts 5, 6. In this embodiment, the gear ratio is shown as 1:1, but other gear ratios can be used with the constraint being that all gears on the crank shafts 35 and 36 should be of identical size.

Figure 12:
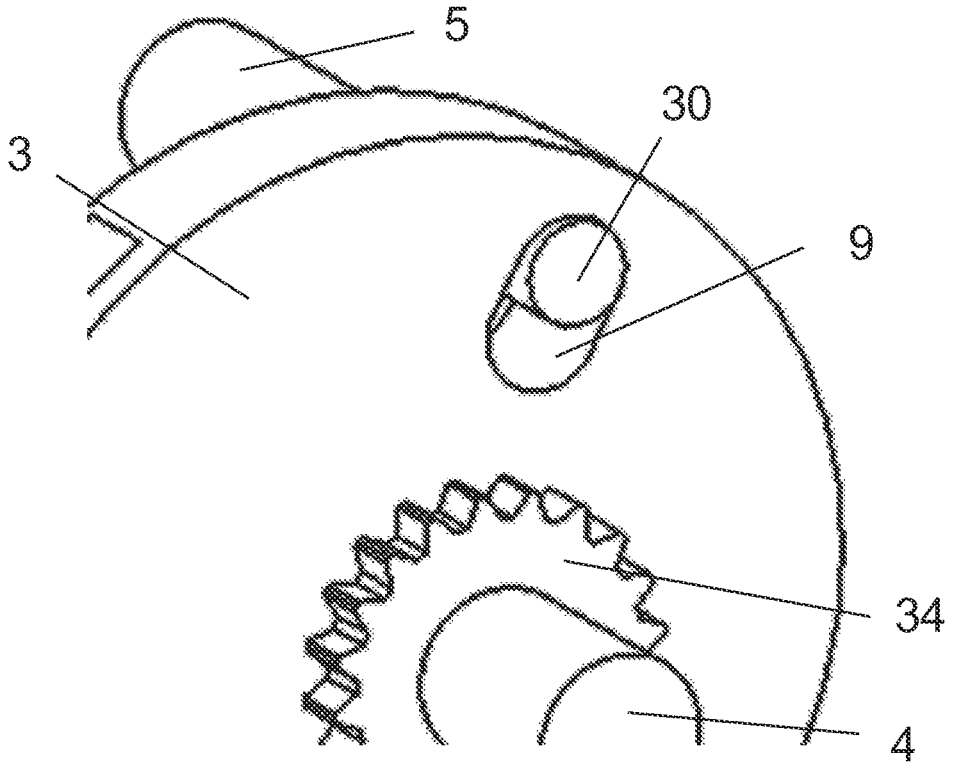
FIG. 12 is a schematic close-up showing a cut-away detail of a cam on one of the crank shafts located in a drive slot on one of the disks.

FIG. 12 shows a cut-away detail of the cam 30 on crank shaft 5 riding in the oval hole 9 on disk 3. As the crank shaft 5 rotates, the disk 3 oscillates back and forth.

Figure 13:
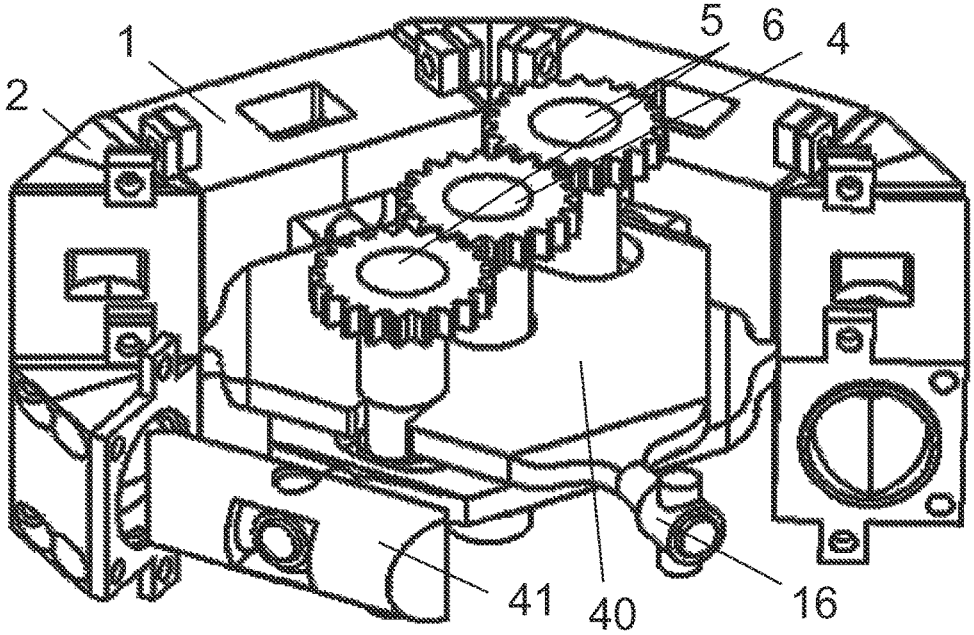
FIG. 13 is a schematic drawing showing a cut-away view of an alternate configuration of the Polygon Oscillating Piston Engine with alternative forms for the disks, the crank shaft slot, and the pistons.

FIG. 13 shows an alternative embodiment of the Polygon Oscillating Piston Engine which has many of the common parts discussed above. The piston cylinders 1, the corner combustion chambers 2 and the shafts 4, 5, and 6 are similar those in FIGS. 1 and 11. For this alternative embodiment, the disk 40 has the piston pegs tilted down, the second disk has the pegs tilted upward so that the pistons in the polygon are all in the same plane and the pegs pass through the center of the piston. Also, the piston 41 is shown with a wedge shaped end instead of a dome. Configurations like this are suited for low power applications where the piston bore is small, the forces are fairly small, and the strength of pegs on the disks is adequate using non-exotic materials.

Figure 14:
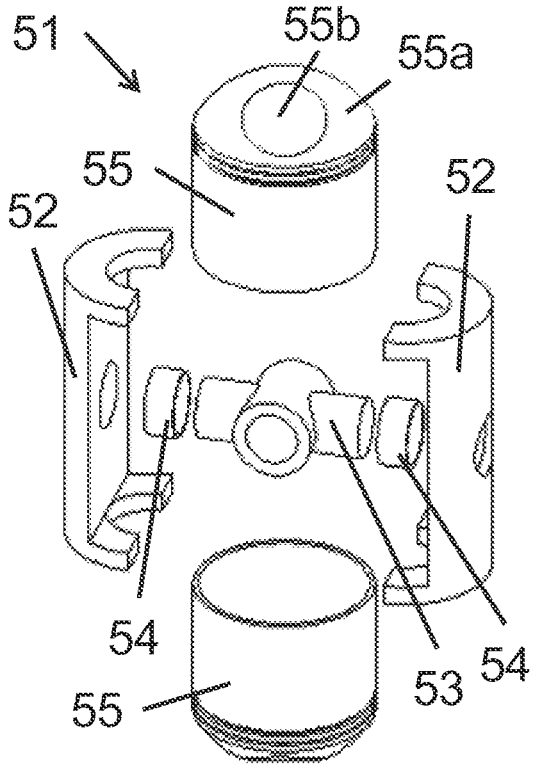
FIG. 14 is a schematic drawing showing an exploded view of an alternative form of the piston assembly which is easy to build and to assemble.

FIG. 14 shows an alternative embodiment of the piston which is made up of seven parts. The full piston assembly 51 has two end caps 55 (shown having domed ends 55*a* with a flattened area 55*b*) which fit over two side braces 52. The side braces 52 come together to hold two small journal bearings 54 which support the piston peg collar 53. With this assembly, the piston is readily manufactured and assembled and its length can be changed to accommodate different compression ratios by merely changing the length of the side braces 52.

Figure 15:
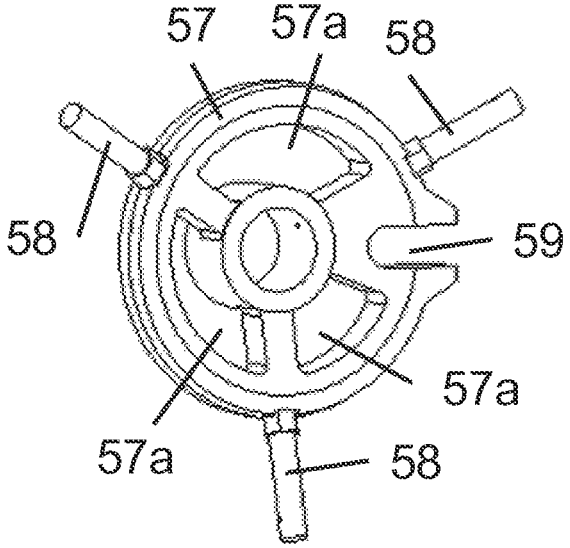
FIG. 15 is a schematic drawing showing an alternative disk with piston pegs mounted at an out-of-plane angle.

FIG. 15 shows an alternative embodiment of the oscillating disk 57 with another embodiment of the piston pegs 58, which are screwed into holes around the perimeter of the disk 57. The piston pegs 58 are provided at an angle out of the plane of the disk 57 to allow for the pistons to all lie in the same plane (see FIG. 17). This disk 57 has a slot 59 for the crank shaft rather than the oval opening of other disk designs described above. Also, the disk has been provided holes 57*a* throughout to make it lighter.

Figure 16:
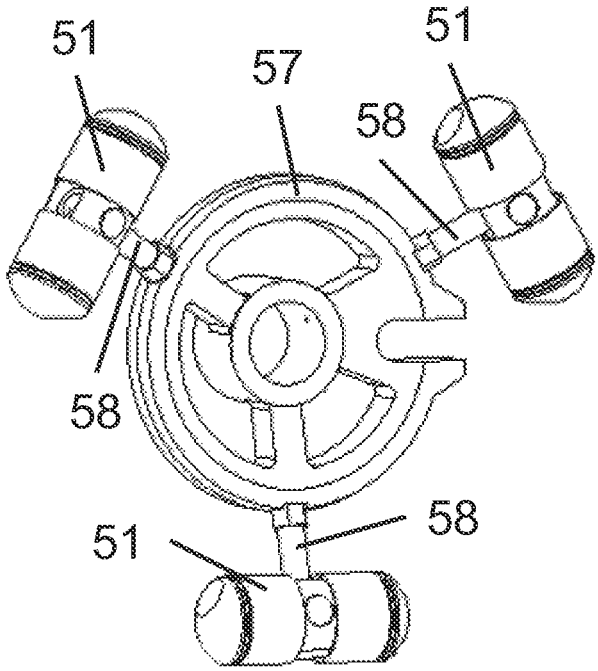
FIG. 16 is a schematic drawing showing three alternate configuration pistons mounted on the piston pegs.

FIG. 16 shows a full alternate piston assembly 51 mounted on the piston pegs 58 connected to disk 57. As the pistons move back and forth in their respective cylinders, the pistons move radially a small amount on the piston pegs.

Figure 17:
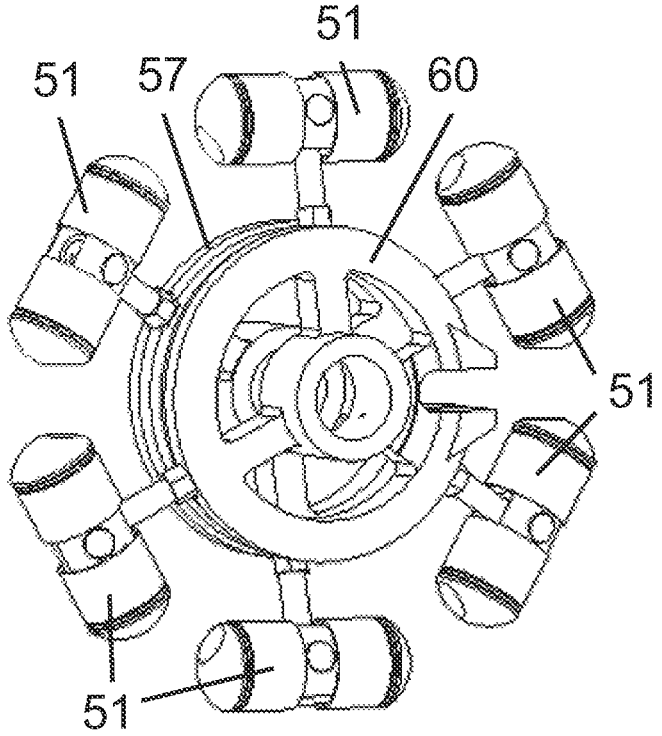
FIG. 17 is a schematic drawing showing two disks with six of the alternate configuration pistons where all pistons are provided in the same plane.

FIG. 17 shows the second disk 60 and pistons 51 on top of the first disk 57 for the alternative embodiment. Disk 60 is identical to disk 57 but flipped by 180 degrees. Providing the piston pegs at an angle out of the plane of the disk makes it possible for all the pistons to be in the same plane and have the piston disks far enough apart to accommodate bearings and support structure for the central main shaft.

Figure 18:
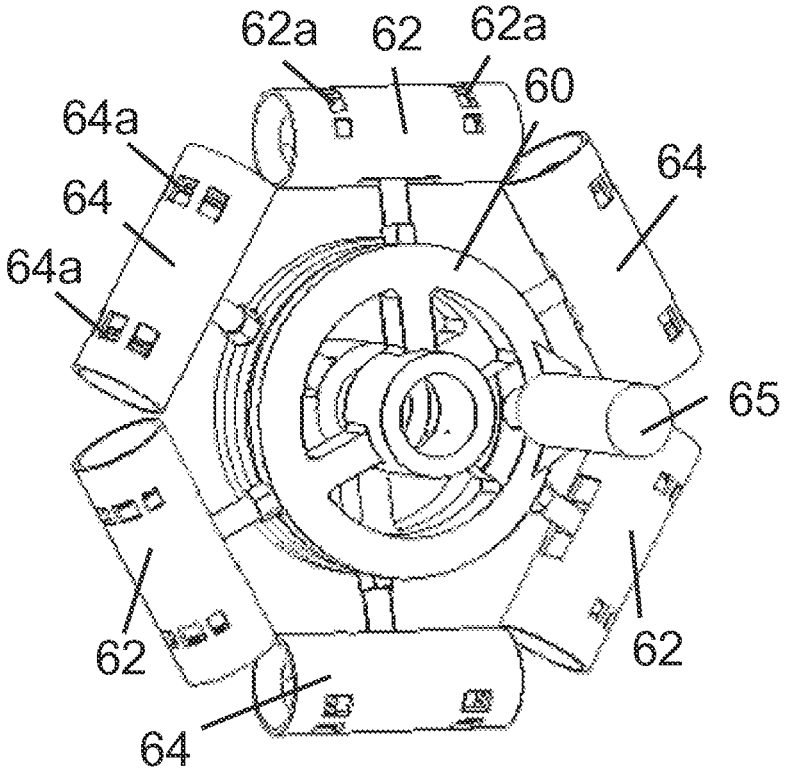
FIG. 18 is a schematic drawing showing piston sleeves with intake and exhaust ports in which the pistons move in a linear manner.

FIG. 18 shows cylinder sleeves added to each of the six pistons for another alternative embodiment. There are two types of sleeves provided for this example embodiment with different types of ports. Sleeves 62 have intake ports 62*a* on both ends, and sleeves 64 have larger exhaust ports 64*a* on both ends. Also shown is the location of the crank shaft 65 which extends through and covers the slots in the disks. It is not required that the same type of port be at the two ends of a sleeve. The sleeves could have intake ports at one end and exhaust ports at the other end, making all six sleeves identical. However, the configuration shown in FIG. 18 has the advantage of reducing the number of external exhaust pipes from 6 to 3, and reducing the number of external intake manifold pipes from 6 to 3, since in both cases the ports for a single the cylinder can be combined into a single manifold.

Figure 19:
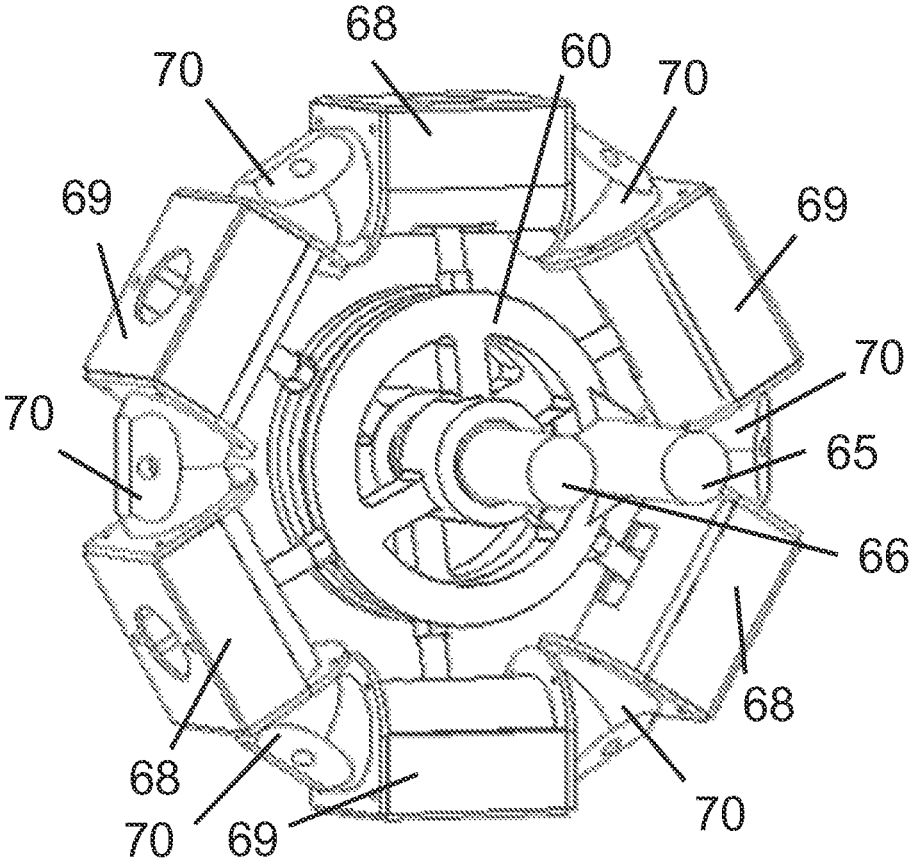
FIG. 19 adds to FIG. 18 corner combustion chambers, manifold covers that enclose the ports, and a central shaft on which the disks oscillate.

FIG. 19 adds more parts to this example embodiment of the Polygon Oscillating Piston Engine. Intake manifolds 68 encase the cylinder sleeves with the intake ports, and exhaust manifolds 69 encase the cylinder sleeves with the exhaust ports. The manifolds combine the function of the ports at both ends of the cylinder sleeves. On the outside the two types of manifold appear to be identical, but on the inside the openings line up with the ports on their respective sleeves. Also shown are the corner combustion chambers 70. On the inside, these are similar to the corner combustion chambers shown in FIGS. 8 and 9. On the outside, they have one or two holes (second hole is on the back side) to accommodate the spark plug, or glow plug, or injector (if used). Also shown is the central shaft 66 on which the disks oscillate. This shaft may or may not rotate, depending upon whether the crank shaft is used as the drive shaft or whether it is geared to the central shaft.

Figure 20:
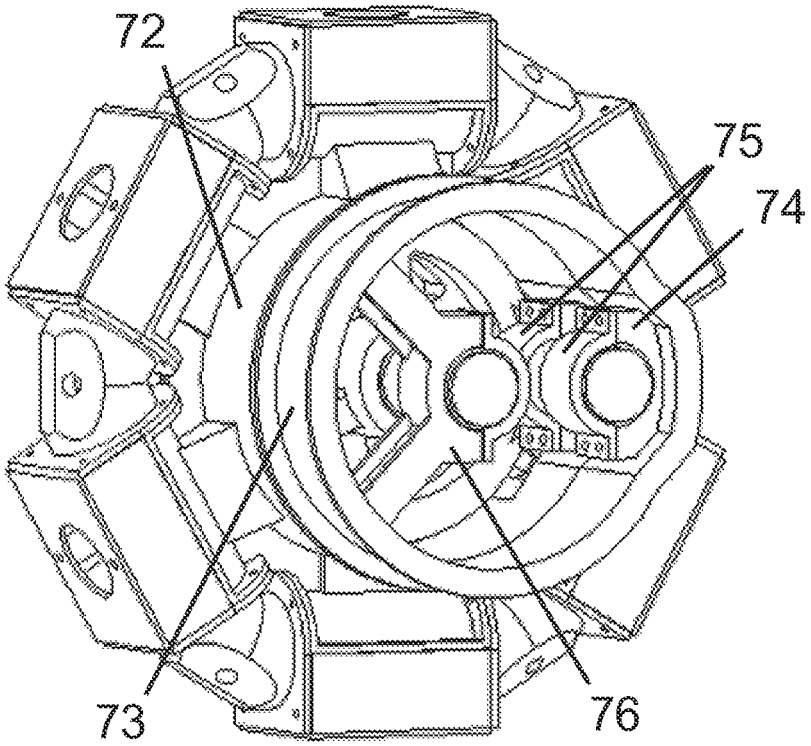
FIG. 20 adds to FIG. 19 an inner and outer engine casing with mounts for a crank shaft and for a center shaft.

FIG. 20 shows a case 72 that encases all the internal parts. The case is used to hold the manifolds, sleeves, and corner pieces in place. In the center, out of view, is also structure between the disks that holds the center shaft and part of the crank shaft. Case 72 has a flange that allows it to be connected to the end case structure 73, which also has structure 74 to hold the crank shaft and structure 76 to hold the center shaft. The crank shaft and center shaft are secured with covers 75 that retain journal bearings.

In FIG. 20, the basic structure with case 72 is stackable. With a single ring of pistons as shown, the engine develops a power stroke twice for every revolution of the crank shaft. This is a feature of the fact that the pistons are double-ended and the fact that this example engine is a two cycle engine. There are portions of the crank cycle where the torque does go negative and a fly wheel would be necessary for operation. But, because the example Polygon Oscillating Piston Engine is modular, multiple rings of pistons can be stacked with an elongated crank shaft and central shaft. With just two rings where the phasing of the second ring of pistons is 90 degrees relative to the first ring, the torque never goes negative, thereby eliminating the need for a heavy fly wheel. The only limitation to the number of modules that can be added is the ultimate strength of the crank shaft. This leads to the next example embodiment of the engine.

Figure 21:
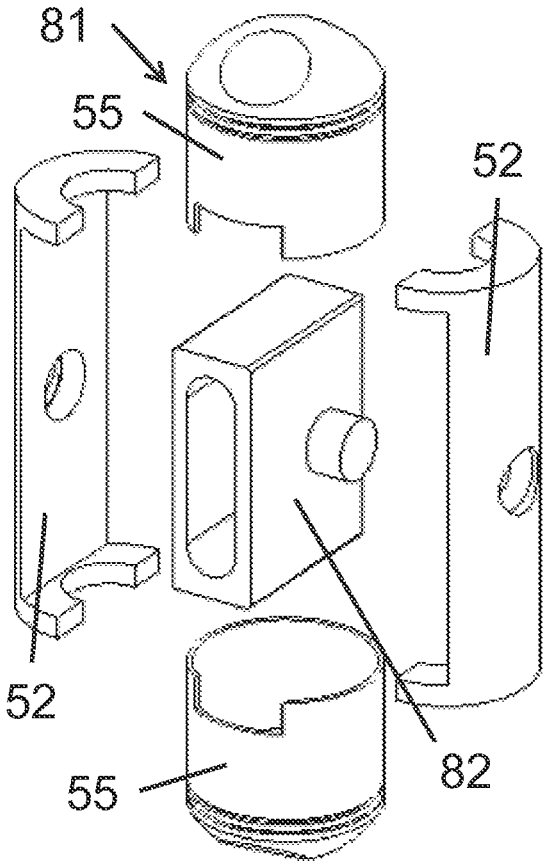
FIG. 21 is a schematic drawing showing an exploded view of an alternative piston assembly with a larger tilt block which is used for higher compression ratio engines with higher combustion pressures.

For high power engines, the strength of materials used for the piston peg and for the crank shaft become a limitation. This difficulty is overcome by another embodiment of the Polygon Oscillating Piston Engine. Shown in FIG. 21 is a piston designed for higher power engines. When the bore of the piston becomes large, and the combustion ratio becomes large, the forces on the piston peg become large. For example, a 3 inch piston with a true combustion ratio of 8.9 (with a two cycle engine the true combustion ratio is less than the geometric combustion ratio because of the size of the exhaust port), the pressure upon combustion can be approximately 1,150 pounds per square inch, which leads to a force on the piston peg of more than 8,000 pounds. If the piston peg is a cylinder as shown in FIGS. 3 and 15, then the required diameter of the peg becomes too large to be accommodated in the space available.

For high power applications, a piston assembly as shown in FIG. 21 can be provided. Here, the piston ends 55 and the piston side braces 52 are the same as in FIG. 14. The piston pivot, however, has new structure as shown as item 82. Here, the near rectangular cross section allows for the added strength needed for these high forces. Because of the shape, the piston would be longer than for the lower power applications.

Figure 22:
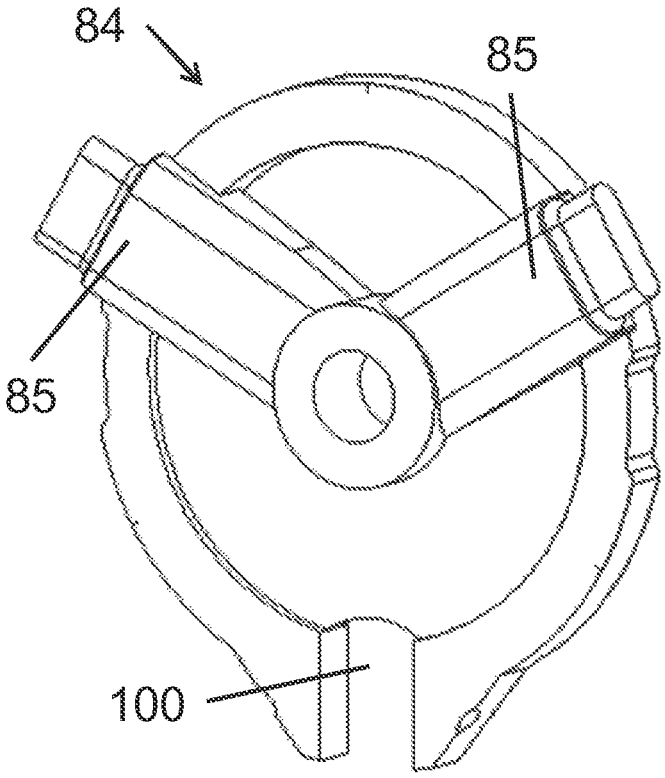
FIG. 22 is a schematic drawing showing an alternate disk configuration which may be used for higher power engines when the crank shaft replaces one of the pistons.

FIG. 22 shows changes to the oscillating disk desired for high power applications. Here, disk 84 contains only two arms 85 to connect to two pistons while the slot for the crank shaft is in the position of the third piston which has been replaced by a crank shaft slot 100 for receiving a larger and stronger crank shaft (not shown).

Figure 23:
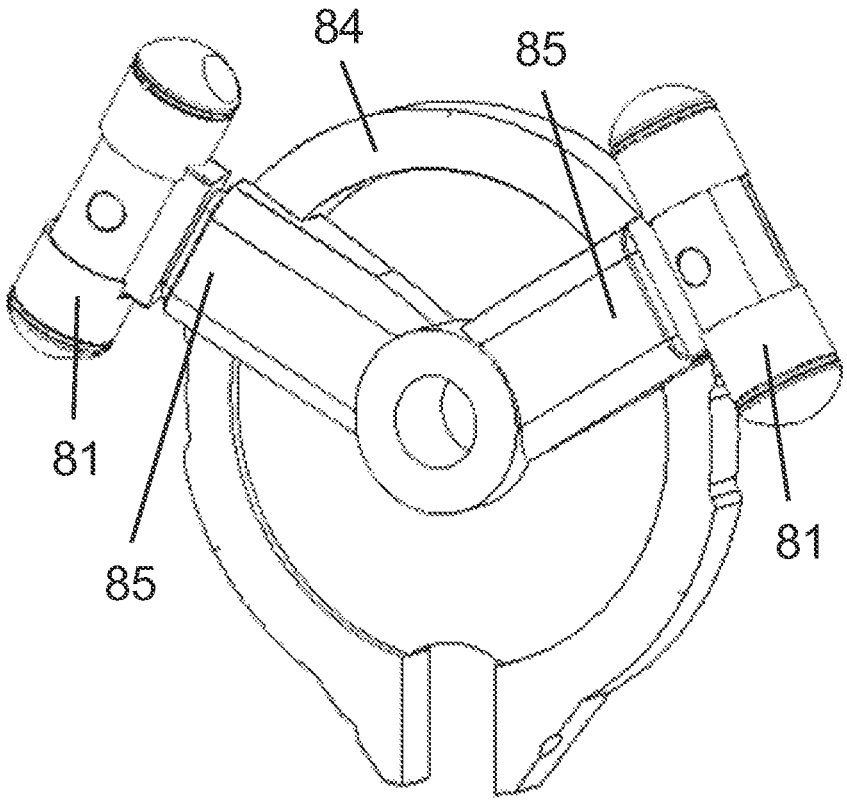
FIG. 23 is a schematic drawing showing two of the alternate pistons mounted on the sliding bars for the high power configuration disk.

FIG. 23 shows the high power pistons 81 placed on the ends of the arms 85 of the disk 84.

Figure 24:
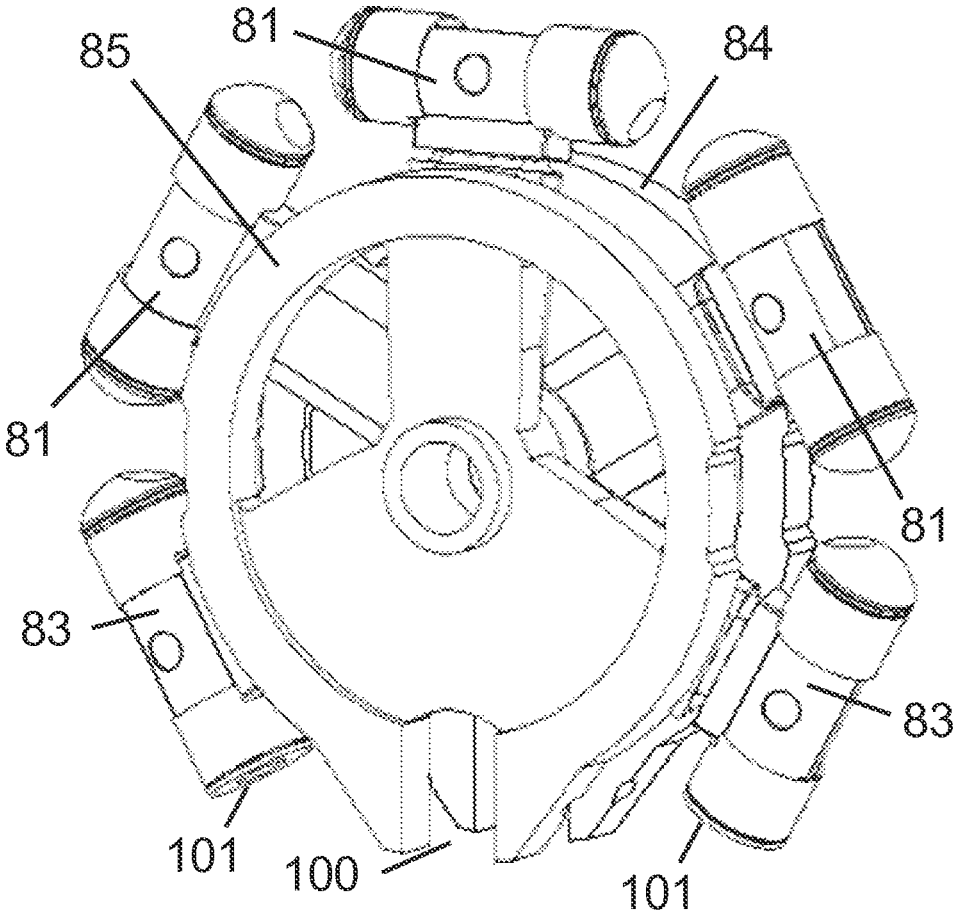
FIG. 24 is a schematic drawing showing the second disk with three pistons where two of the pistons are open at one end.

FIG. 24 shows a primary difference between this example high-powered embodiment of the Polygon Oscillating Piston Engine and the other example embodiments shown in FIGS. 1 through 20. Here, there are only five pistons 81 provided for the hexagonal configuration. The position of the last piston 81 is replaced by the crank shaft slot 100. This would be true no matter how many sides there are to the polygon engine. If the polygon is N sided, there would be N−1 pistons. Three of the five pistons 81 are identical and have power producing faces at both ends. Two of the pistons 83 are different in that they only have one end that produces power (the other end 101 is open).

Figure 25:
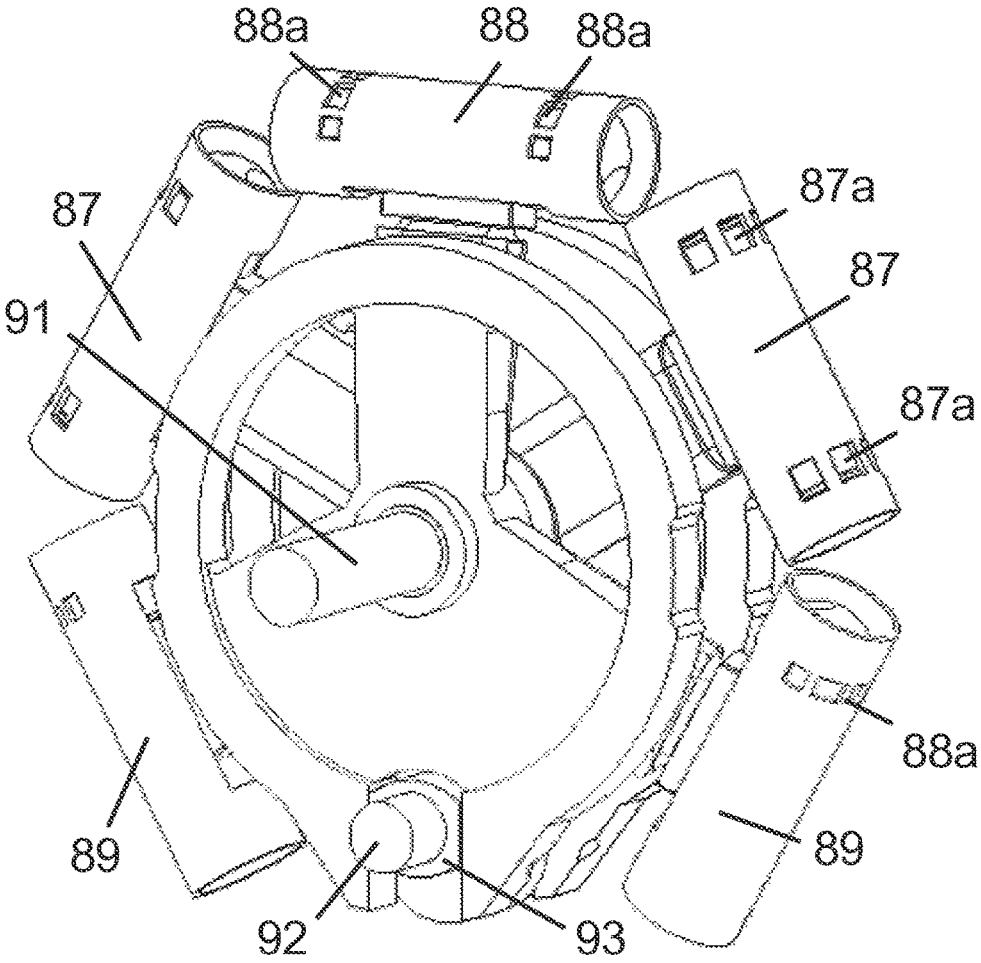
FIG. 25 adds the piston sleeves to the alternate piston configuration where two sleeves have exhaust ports and the other three have intake ports.

FIG. 25 adds the cylinder sleeves 87 to the pistons. Here, sleeves 87 contain the exhaust ports 87*a* and the two sleeves are identical. Sleeve 88 contains the intake ports 88*a* which are the same at both ends. The two sleeves 89 also contain intake ports 88*a*, but they only occur at one end of the sleeve. Also shown is the center shaft 91 and a portion of the crank shaft 92. As in all occurrences of the scotch yoke in the above embodiments, but made more explicit here, there is a slider block 93 that allows the crank shaft to rotate while sliding in the slot of the oscillating disk.

Figure 26:
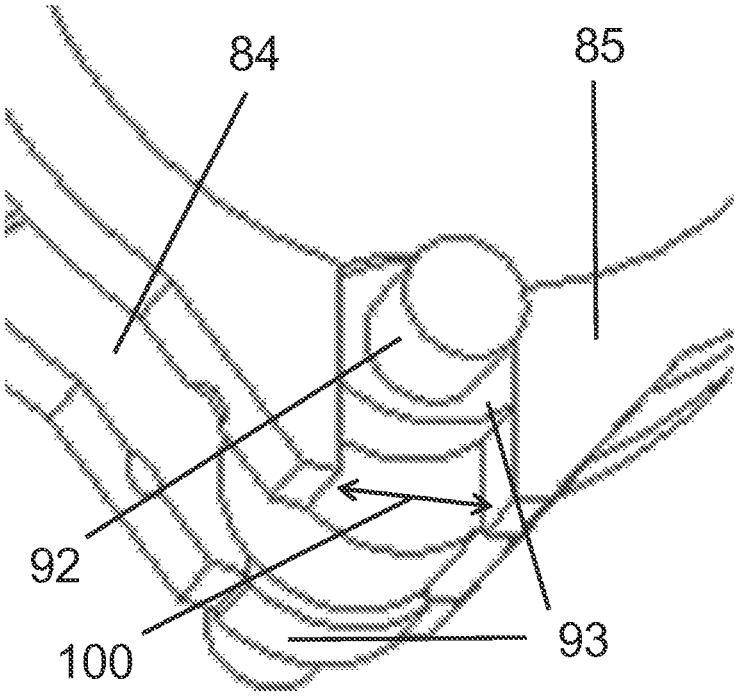
FIG. 26 is a schematic drawing showing detail of how the oscillating disks connect to the rotating crank shaft with slider blocks in a scotch yoke configuration.

FIG. 26 shows a detail of the slider block. Portions of the disks 84 and 85 are shown near the slots 100 for the crank shaft. The crank shaft 92 rides within the slider blocks 93 as the crank shaft rotates. Lubrication for these joints is provided through channels in the disks.

Figure 27:
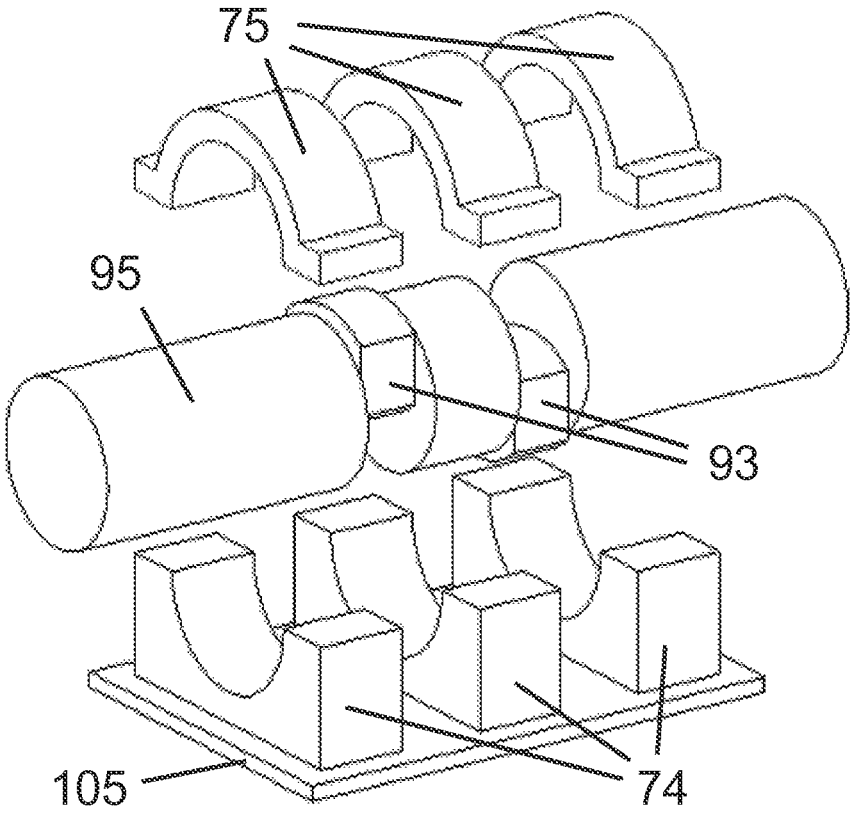
FIG. 27 is a schematic drawing showing detail of how the crank shaft with slider blocks is held by the engine structure.

FIG. 27 shows detail of one example of how the crank shaft can be supported by the case. The channels 74 on the mount 105 carry the crank shaft 95. The covers 75 capture journal bearings (not shown) that hold the crank shaft 95 in place and allow for lubrication. The slider blocks 93 are split (similar to what is done with journal bearings) to allow for easy installation.

Figure 28:
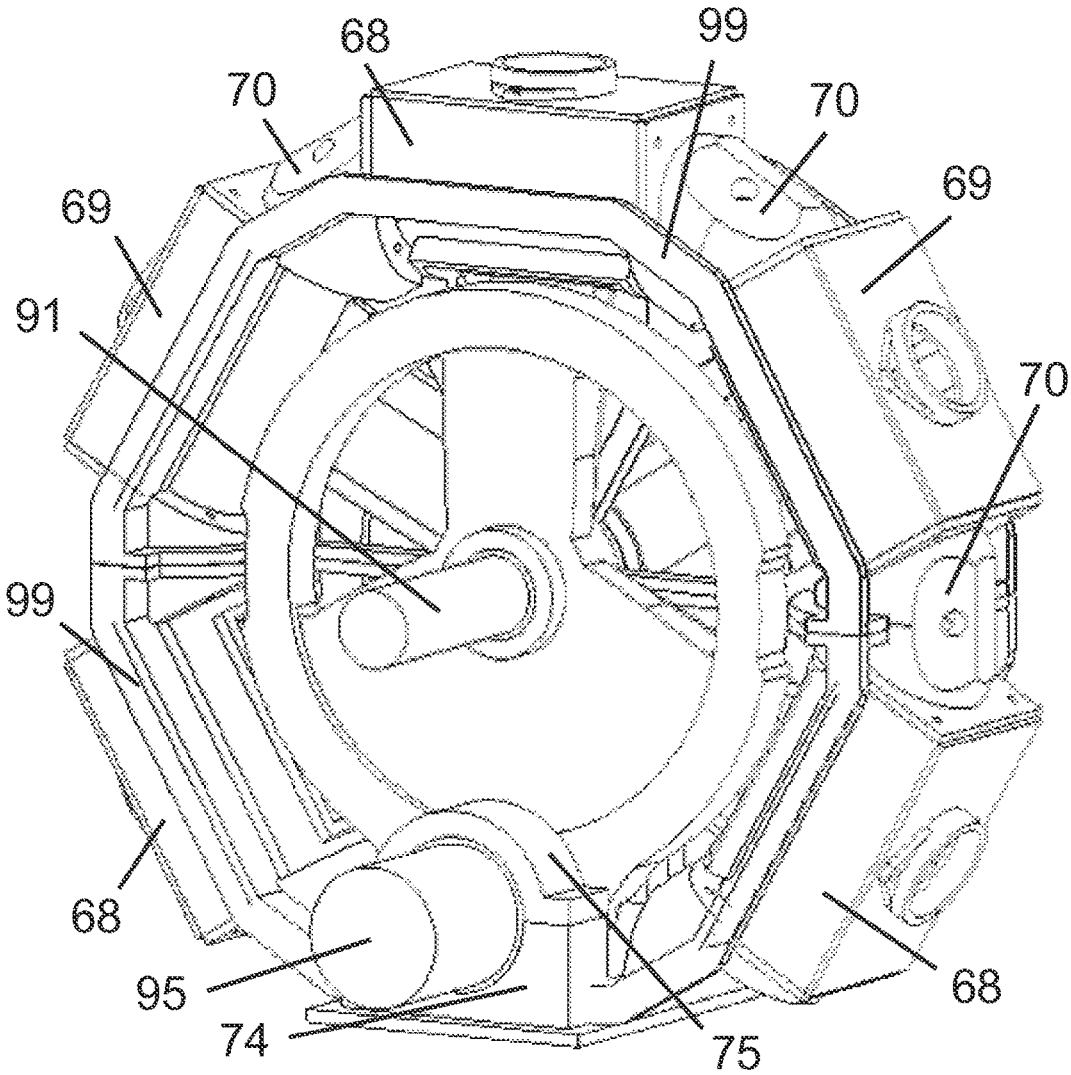
FIG. 28 is a schematic drawing showing the alternate configuration of the Polygon Oscillating Piston Engine used for high power applications where one of the sides of the polygon is replaced with the crank shaft.

Finally, FIG. 28 shows the basic parts assembled of this embodiment of the Polygon Oscillating Piston Engine (sometimes this embodiment is called the Arc Engine). The three intake manifolds 68 and the two exhaust manifolds 69 are the same as in FIG. 19. There are four corner combustion chambers 70 (one is hidden by the case). The ends of the pistons that are not covered with a corner chamber have end caps where no combustion occurs. So this embodiment has two less combustion chambers than sides to the polygon. The case that holds all together is shown as item 99 and comes in two pieces for easy assembly. The case has a flange as shown that allows the rings of pistons to be stacked. As in the previous discussion, multiple rings of pistons can be mounted on the same central shaft and crank shaft. When this is done, the phasing of the timing of the combustion in the chambers in separate rings can be staggered so as to produce a smoother running engine. In the usual embodiment, there will be at least two rings of pistons, but any number of rings can be used.

In the initial embodiments discussed above, the polygon engine can have any even number N of sides, has N pistons, and N combustion chambers. In the high-powered embodiment, the engine has N sides, N−1 pistons, and N−2 combustion chambers. (It is possible to add combustion chambers to the ends of the end pistons to give N combustion chambers, but these last two chambers would not be opposed pistons and they add additional manifolds and different porting. The power advantage that one might get from the added complexity can be more easily accommodated with slightly larger pistons). Even though there are fewer combustion chambers, this high-powered embodiment allows for very high power engines because the size of the parts that carry the large loads can be made arbitrarily large. For example, an engine with 3 inch pistons, a stroke of 1.8 inches, an actual compression ratio of 8.9, a piston speed of 3500 feet per minute (piston speeds on commercial engines can run at >4000 feet per minute) and two rings of pistons (10 total pistons) can develop around 980 horsepower at 11,500 rpm (not its maximum speed). The weight of the parts shown in FIG. 28 can be under 200 pounds. With the double ring and the end covers, the weight is under 450 pounds, giving an example engine with a specific power greater than 2.0 (specific power is horsepower per pound weight).

In the embodiment described herein, several parts and systems that are typically provided for the engine to function have been omitted. These include the fuel supply system, the exhaust system, and the valve and spark plug timing system. Each of these systems can be implemented in a number of ways, each of which is currently in common practice with reciprocating engines. There are not necessarily any specific requirements for these systems imposed by the Polygon Oscillating Piston Engine, and a number of different embodiments of these parts and systems can be utilized.

Hence, provided by one or more of these example embodiments is:

1. An Oscillating Piston Engine where the pistons are arranged in a polygon.
2. An Oscillating Piston Engine where the polygon can have any even number of sides.
3. An Oscillating Piston Engine where the combustion chamber at the corners of the polygon can have any shape necessary to accommodate the shape of the ends of the pistons.
4. An Oscillating Piston Engine that can be configured as a two cycle engine, a four cycle engine, or an expander.
5. An Oscillating Piston Engine where the combustion can be ignited by either a glow plug, a spark plug, or no plug as a diesel.
6. An Oscillating Piston Engine where the oscillation of the disk with pistons is transferred to a rotary motion by a cam on a crank shaft rotating in a slider block which moves in a slot on the disk.
7. An Oscillating Piston Engine where the oscillation of the disk with pistons is transferred to a rotary motion by a push arm on the disk that is connected to a cam on a crank shaft. (this is mentioned in words only, but is important since the slider block may be a weakness to the design, and we may replace the slider block with the push arm configuration. This is discussed fully in our previous patent application for the Toroidal Engine)
8. An Oscillating Piston Engine where there are multiple rings of pistons in polygons arranged on a single main shaft.
9. A Polygon Oscillating Piston Engine were one side of the polygon is filled with the crank shaft. (an Arc Engine)
10. An Arc Engine where multiple arcs of pistons are combined on a single crank shaft to give high power.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be necessary to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. An engine comprising:

at least a first disc having an axial hole and at least a first offset hole;

at least a first piston connected to said first disc for converting a linear motion of the first piston into an oscillating motion in said first disc;

a main shaft passing through said axial hole;

at least a first crank shaft passing through said first offset hole and connecting to said main shaft for converting a rotation of said first crank shaft into a rotation of said main shaft; and a first connecting mechanism for generating a rotation of said first crank shaft from said oscillating motion of the first disc.

2. The engine of claim 1, further comprising:

a second disc having an axial hole and a first offset hole, wherein said main shaft passes through said axial hole of the second disc and wherein said first crank shaft also passes through said first offset hole of said second disc;

a second piston connected to said second disc for converting a motion of the second piston into an oscillating motion in said second disc; and a second connecting mechanism for generating a rotation of said first crank shaft from said oscillating motion of the second disc.

3. The engine of claim 2, wherein said first disc oscillates in a manner that opposes the oscillation of the second disc.

4. The engine of claim 2, wherein said first piston is arranged to oppose said second piston.

5. The engine of claim 2, further comprising a plurality of additional pistons, such that each one of said additional pistons is arranged to connect to one or the other of said first disc and said second disc for converting a linear motion of each one of the pistons into an oscillating motion in the connected one of the first disc or the second disc.

6. The engine of claim 2, further comprising a chamber for at least partially containing said first piston and said second piston such that said first piston with said first disk and said second piston with said second disk are arranged with said chamber for forming at least one expansion volume.

7. The engine of claim 2, wherein a piston pair is formed including said first piston arranged opposing said second piston, said apparatus further comprising a housing for forming a chamber corresponding to the piston pair, such that the first piston and the second piston are arranged within the chamber for forming an expansion volume between said first piston and said second piston.

8. The engine of claim 7, wherein said chamber is arranged as a circular cylinder for receiving the linear motion of the first piston and the second piston.

9. The engine of claim 1, further comprising a second crank shaft passing through a second offset hole provided in the first disc, and also passing through a second offset hole of the second disc if present, said second crank shaft also connecting to said main shaft for converting a rotation of said second crank shaft into a rotation of said main shaft.

10. The engine of claim 1, wherein said first crankshaft has a gear for connecting to a corresponding gear on said main shaft for performing said converting.

11. The engine of claim 1, wherein said connecting mechanism includes a crank provided on said crank shaft for engaging said first offset hole of said first disk.

12. The engine of claim 1, wherein said engine is adapted for injecting a gas into an expansion volume at least partially containing said first piston for causing said expansion volume to expand, thereby imposing a torque on said first disk via said first piston.

13. The engine of claim 1, wherein said engine is adapted for injecting a gas that is a fuel/air mixture into an expansion volume at least partially containing said first piston for compression in said expansion volume such that ignition of said fuel/air mixture causes said expansion volume to expand, thereby imposing a torque on said first disk via said first piston.

14. The engine of claim 1, wherein each one of the offset holes are formed such that the discs in which the offset holes are formed can freely oscillate about the crankshaft passing through that offset hole.

15. The engine of claim 1, wherein a piston pair is formed including said first piston arranged opposing another piston, said apparatus further comprising a housing for forming a chamber corresponding to the piston pair, such that the first piston and the second piston are arranged within the chamber opposing each other.

16. The engine of claim 15, wherein said chamber is arranged as a circular cylinder for receiving the linear motion of the first piston and the second piston.

17. The engine of claim 15 further comprising:

a plurality of additional opposing piston pairs arranged with said piston pair around a circumference having a center axis;

a housing for containing said piston pairs in a compressible volume, wherein each piston in each piston pair alternatively oscillates toward and away from a fixed point between the pistons of the piston pair.

18. The engine of claim 17, wherein said housing is arranged as a polygon.

19. The engine of claim 17, wherein said first offset hole is provided as an open slot on a circumference of the first disk.

20. An engine comprising:

a piston pair including a first piston arranged opposing a second piston;

a housing for forming a cylindrical chamber corresponding to the piston pair, such that the first piston and the second piston are arranged within the chamber for forming an expansion volume between said first piston and said second piston, with the first piston and the second piston being configured for travel in a linear motion within said cylindrical chamber;

a main shaft;

a first disc connected to a first piston;

a second disk connected to a second piston;

a mechanism for converting the linear motion of said first piston into an oscillation of said first disc, and a mechanism for converting the linear motion of said second piston into an oscillation of said second disc, said linear motion of said first piston and said second piston caused by an expansion of said expansion volume; and one or more transmission mechanisms for connecting said first disc and said second disc to said main shaft for rotating said main shaft when said first disc and said second disc are oscillated.

21. An engine comprising:

a plurality of piston pairs, each one of said piston pairs including a first piston arranged opposing a second piston;

a main shaft;

at least one disc;

a mechanism for generating an oscillation in said disc from a relative linear motion of at least one of said piston pairs; and a mechanism for transforming the oscillation of said disc into a rotation of the main shaft.

22. The engine of claim 21, providing a plurality of said discs each for transforming a respective oscillation into a rotation of said main shaft.

23. The engine of claim 21, wherein said mechanism for transferring the oscillation of said at least one disc into a rotation of the main shaft is comprised of at least one crank shaft connecting to said main shaft.

24. An engine comprising:

at least one piston;

a main shaft;

at least one disc; and a mechanism for generating an oscillation in the at least one disc from a linear motion of said at least one piston, wherein said oscillation of said at least one disc is converted into a rotation of the main shaft.

25. The engine of claim 24, where said at least one piston is comprised of a plurality of opposing piston pairs.

26. The engine of claim 25, wherein one piston of each one of said piston pairs is mounted on a first disk, and wherein the other piston of each one of said piston pairs is mounted on a second disk.

27. The engine of claim 26, wherein during operation, said piston pairs impose an oscillation on said first disk, and an opposing oscillation on said second disk, and wherein said oscillations are converted into a rotation of said crank shafts.

28. An engine comprising:

a first disk having formed therethrough a first axial hole and a first offset hole offset from the axis of said first disk;

a second disk having formed therethrough a second axial hole and a second offset hole offset from the axis of said second disk;

a first piston attached to a circumference of said first disk;

a second piston attached to a circumference of said second disk;

a main shaft passing through said first axial hole and said second axial hole, wherein said main shaft can rotate within said first axial hole and said second axial hole;

a crank shaft passing through said first offset hole and said second offset hole, wherein said crank shaft can rotate within said first offset hole and said second offset hole;

a transmission mechanism for connecting said crank shaft to said main shaft, said transmission mechanism being structured such that a rotation of said crank shaft imposes a rotation on said main shaft;

an oscillation transmission mechanism for connecting at least one of said first disk or said second disk to said crank shaft, said oscillation transmission mechanism being structured for transmitting an oscillation of said one of said first disk or said second disk into a rotation of said crank shaft; and a housing, wherein said housing forms a cylindrical chamber for at least partially containing said first piston and said second piston such that said first piston on said first disk and said second piston on said second disk are arranged with said chamber for forming an expansion volume between said first piston and said second piston for accepting a linear motion of said first piston and said second piston, and wherein said expansion volume alternatively compresses and expands a volume within said expansion volume as said engine is operating by the oscillation of at least said one of said first disk or said second disk about said main shaft, thereby converting said oscillation to a rotation of said crank shaft which thereby rotates said main shaft.

29. The engine of claim 28, wherein said first offset hole is provided as an open slot on a circumference of the first disk and wherein said second offset hole is provided as an open slot on said second disk.

30. An engine comprising:

a first disk having formed therethrough a first axial hole and a first offset hole, said first offset hole being offset from the axis of said first disk;

a second disk having formed therethrough a second axial hole and a second offset hole, said second offset hole being offset from the axis of said first disk, wherein said second offset hole is placed a distance from the axis of said second disk corresponding to the distance said first offset hole is placed from the axis of said first disk;

a plurality of piston pairs, each of said piston pairs including a first piston attached to a circumference of said first disk and a second piston attached to a circumference of said second disk;

a main shaft passing through said first axial hole and said second axial hole, said main shaft having a main gear;

a crank shaft passing through said first offset hole and also passing through said second offset hole;

a crank shaft gear attached to said crank shaft for connecting said crank shaft to said main gear of said main shaft for transmitting a rotation of said crank shaft to the main shaft;

a transmission for transmitting an oscillation of said first disk into a rotation of said crank shaft; and a housing, wherein said housing forms at least one cylindrical chamber for at least partially containing said plurality of piston pairs, such that the first piston and the second piston of each one of said piston pairs are arranged with said at least one chamber for forming a corresponding expansion volume between said first piston and said second piston, and wherein for each expansion volume, the corresponding piston pair alternatively compresses and expands the volume within the expansion volume through the linear motion of said corresponding piston pair as said engine is operating by the oscillation of said first disk about said main shaft, thereby converting said oscillation of said first disk into a rotation of said crank shaft which thereby rotate said main shaft.

31. The engine of claim 30, wherein said first offset hole is provided as an open slot on a circumference of the first disk and wherein said second offset hole is provided as an open slot on said second disk.

* * * * *